US008864133B2

(12) United States Patent
Takai et al.

(10) Patent No.: US 8,864,133 B2
(45) Date of Patent: Oct. 21, 2014

(54) DEVICE FOR CORRECTING AN EDGE PORTION OF A SHEET MATERIAL AND ELECTROPHOTOGRAPHIC IMAGE FORMING APPARATUS

(71) Applicants: Shingo Takai, Ibaraki (JP); Toshihiro Nakagaki, Ibaraki (JP)

(72) Inventors: Shingo Takai, Ibaraki (JP); Toshihiro Nakagaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/836,862

(22) Filed: Mar. 15, 2013

(65) Prior Publication Data

US 2013/0241146 A1 Sep. 19, 2013

(30) Foreign Application Priority Data

Mar. 16, 2012 (JP) ..... 2012-060460
Oct. 24, 2012 (JP) ..... 2012-234678

(51) Int. Cl.

*B65H 29/70* (2006.01)
*B41J 13/00* (2006.01)
*B65H 29/12* (2006.01)
*G03G 15/00* (2006.01)

(52) U.S. Cl.

CPC ..... *B41J 13/00* (2013.01); *B65H 29/12* (2013.01); *B65H 29/70* (2013.01); *G03G 15/6567* (2013.01); *G03G 2215/0129* (2013.01)
USPC ..... 271/272; 271/188; 271/209; 271/161; 492/27

(58) Field of Classification Search

USPC ..... 271/188, 209, 272–274, 228, 252; 492/27

See application file for complete search history.

(56) References Cited

U.S. PATENT DOCUMENTS

| | | | | |
|---|---|---|---|---|
| 2008/0247797 | A1 | 10/2008 | Yoshino et al. | |
| 2010/0164166 | A1 | 7/2010 | Furusawa et al. | |
| 2010/0215418 | A1 | 8/2010 | Kawahata et al. | |
| 2012/0177417 | A1 * | 7/2012 | Fujita et al. | 399/297 |

FOREIGN PATENT DOCUMENTS

| | | | |
|---|---|---|---|
| JP | 59198238 | A * | 11/1984 |
| JP | 2002-224748 | | 8/2002 |
| JP | 2005-179041 | | 7/2005 |
| JP | 3918912 | | 5/2007 |
| JP | 2008-049461 | | 3/2008 |
| JP | 2008-073819 | | 4/2008 |
| JP | 2008-185649 | | 8/2008 |
| JP | 2008-254887 | | 10/2008 |
| JP | 2008-273673 | | 11/2008 |
| JP | 2009-234751 | | 10/2009 |
| JP | 2010-116221 | | 5/2010 |
| JP | 2010-132403 | | 6/2010 |
| JP | 2010-150010 | | 7/2010 |

(Continued)

*Primary Examiner* — Luis A Gonzalez

(74) *Attorney, Agent, or Firm* — Oblon, Spivak, McClelland, Maier & Neustadt, L.L.P.

(57) ABSTRACT

Disclosed is a device for correcting an edge portion of a sheet material, including a first roller provided in a sheet material conveying path, a second roller including a center shaft and side rollers provided at both sides thereof, the center shaft having an outer diameter less than a minimum diameter of the side rollers, each of the side rollers having an outer diameter increasing from a center side to an outer side thereof, and a pressing unit configured to cause the second roller to bend toward the first roller to press the side rollers of the second roller against the first roller.

8 Claims, 6 Drawing Sheets

(56) References Cited

FOREIGN PATENT DOCUMENTS

| | | |
|---|---|---|
| JP | 2010-195525 | 9/2010 |
| JP | 2010-276846 | 12/2010 |
| JP | 2011-107580 | 6/2011 |
| JP | 2011-121701 | 6/2011 |
| JP | 2011-121710 | 6/2011 |

* cited by examiner

DEVICE FOR CORRECTING AN EDGE PORTION OF A SHEET MATERIAL AND ELECTROPHOTOGRAPHIC IMAGE FORMING APPARATUS

BACKGROUND OF THE INVENTION

1. Field of the Invention

An aspect of the present invention relates to at least one of a device for correcting an edge portion of a sheet material and an electrophotographic image forming apparatus.

2. Description of the Related Art

As image forming apparatuses such as copying machines, printers, facsimile machines, and complex devices formed with those machines, various image forming apparatuses using electrophotographic techniques have been developed and have become publicly known arts. An image forming process used in such image forming apparatuses includes the following steps: forming an electrostatic latent image on the surface of a photosensitive drum serving as an image carrier, developing and visualizing the electrostatic latent image on the photosensitive drum with a developer such as toner, transferring the developed image onto a recording paper sheet (also referred to as a sheet material, a paper sheet, a recording material, or a recording medium) with a transfer device so that the recording paper sheet carries the image, and fixing the toner image on the recording paper sheet with a fixing device using pressure, heat, and the like.

In the fixing device, a fixing member (a fixing unit) formed with rollers or belts facing each other or a combination of the rollers and the belts is in contact with a pressure member (a pressure unit), to form a nip unit. A recording paper sheet is inserted into the nip unit, and heat and pressure are applied to the nip unit, to fix a toner image on the recording paper sheet.

Recording paper sheets used in image forming apparatuses are formed by cutting and dividing a base paper sheet into sheets of various sizes that have been standardized. At the time of processing, however, so-called "burrs" such as minute notches and scratches may appear at the cut edges of the recording paper sheets obtained by the cutting.

It is known that the burrs may cause the belts or the like of the fixing device to wear, and degrade printing quality. Particularly, it is known that burrs formed at the edges in the paper width direction, rather than burrs formed at the top and rear edges in the paper conveying direction, may leave streaky surfaces on the belts. Therefore, various edge correcting devices (burr squashing devices) for sheet materials have been suggested.

For example, Japanese Laid-Open Patent Application No. 2005-179041 discloses an image forming apparatus that corrects burrs by pressing a smoothing member (a roller) having an irregular surface against the burrs. Japanese Laid-Open Patent Application Nos. 2008-254887, 2010-150010, 2010-132403, and 2010-276846 also disclose burr removing devices and the like that remove burrs by inserting a paper sheet between two rollers to which a high pressure is applied.

However, it may not be possible to readily apply the techniques disclosed in the above mentioned patent literatures to various kinds of sheet materials of different sizes, and a problem may still remain that a load is applied to portions other than the edges of sheet materials. Therefore, sufficiently high efficiency may not have been achieved yet in squashing burrs.

SUMMARY OF THE INVENTION

According to one aspect of the present invention, there is provided a device for correcting an edge portion of a sheet material, including a first roller provided in a sheet material conveying path, a second roller including a center shaft and side rollers provided at both sides thereof, the center shaft having an outer diameter less than a minimum diameter of the side rollers, each of the side rollers having an outer diameter increasing from a center side to an outer side thereof, and a pressing unit configured to cause the second roller to bend toward the first roller to press the side rollers of the second roller against the first roller.

According to another aspect of the present invention, there is provided an electrophotographic image forming apparatus, including the device for correcting an edge portion of a sheet material as described above.

DETAILED DESCRIPTION OF THE PREFERRED EMBODIMENTS

In the following, some embodiments of the present invention will be described with reference to the accompanying drawings.

A structure according to an embodiment of the present invention will be described in detail, based on an embodiment illustrated in FIGS. 1 through 6.

(Image Forming Apparatus)

Figure 1:
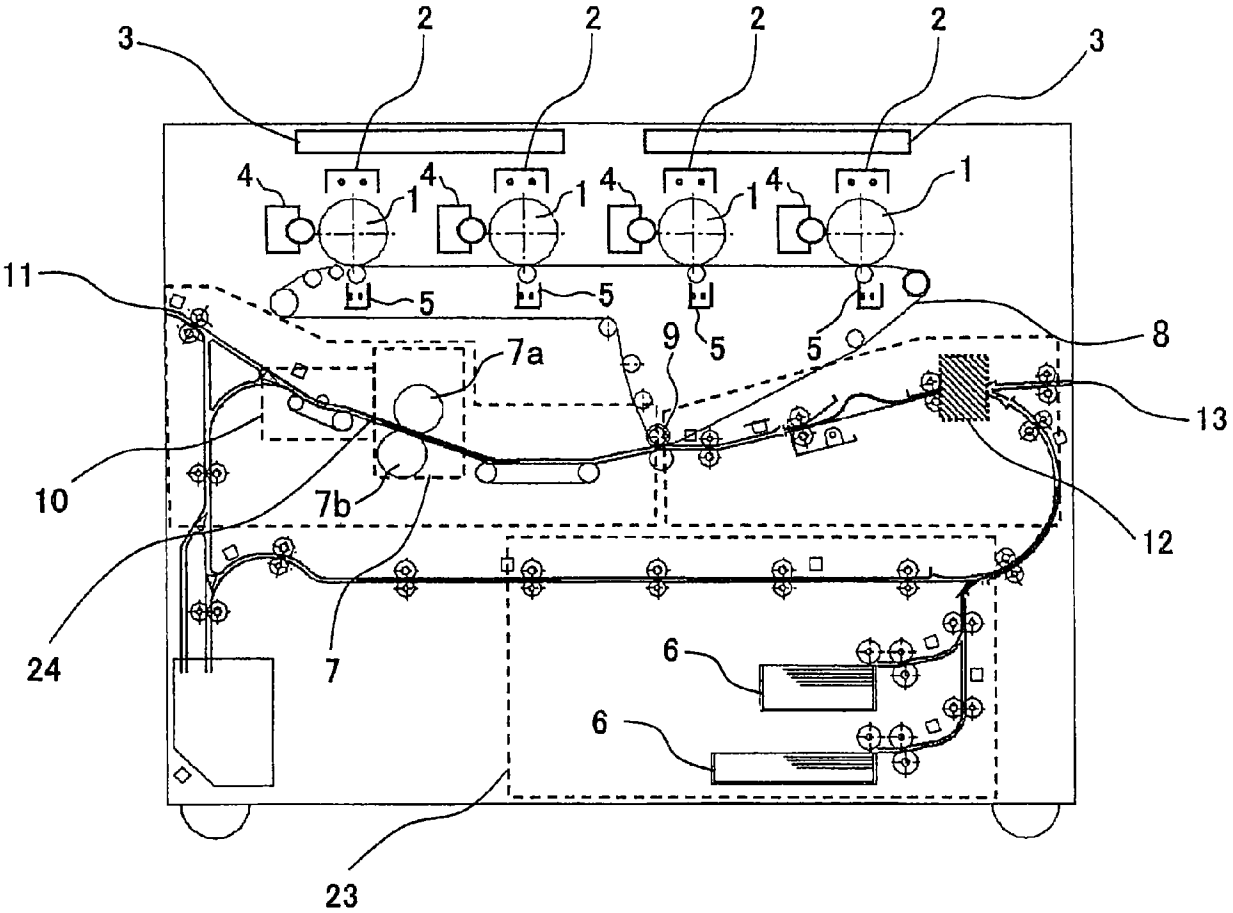
FIG. 1 is a cross-sectional view of an image forming apparatus according to an embodiment of the present invention.

FIG. 1 illustrates the entire structure of an image forming apparatus according to an embodiment of the present invention. As illustrated in FIG. 1, corona chargers 2, developing devices 4, cleaning units (not illustrated), neutralizers (not illustrated), and the like are provided around respective photosensitive drums 1 (Y, M, C, K). An image forming process is performed on the respective photosensitive drums 1, and images in the respective colors are formed on the respective photosensitive drums 1.

The photosensitive drums 1 are rotationally driven by drive motors (not illustrated). At the positions of the corona chargers 2, the surfaces of the photosensitive drums 1 are uniformly charged (the charging process).

After that, the photosensitive drums 1 reach positions irradiated with laser beams emitted from image writing devices 3, and exposure and scanning are performed at those positions, to form electrostatic latent images corresponding to the respective colors (the exposure process).

The surfaces of the photosensitive drums 1 then reach the positions facing the developing devices 4. The electrostatic latent images are developed at those positions, and toner images in the respective colors are formed (the development process).

The surfaces of the photosensitive drums 1 then reach the positions facing an intermediate transfer belt 8 and first transfer units 5, and, at those positions, the toner images on the photosensitive drums 1 are transferred onto the intermediate transfer belt 8 (the first transfer process). In this manner, a color image is formed on the intermediate transfer belt 8.

The toner that has not been transferred and remains on the photosensitive drums 1 is collected by the cleaning units (not illustrated) (the cleaning process). When the photosensitive drums 1 reach the positions facing the neutralizers (not illustrated), the residual potential on the photosensitive drums 1 is removed at those positions.

The intermediate transfer belt 8 having the toner images in the respective colors transferred and overlapped thereon then reaches a second transfer unit 9. At this position, the toner images are transferred onto the surface of a paper sheet 6 conveyed from a paper feeder 23 through a conveyance path 24 (the second transfer process).

The paper sheet 6 having the toner images transferred thereto is then sent into a fixing device 7, and is subjected to heat and pressure while passing between a fixing belt 7*a* and a pressure roller 7*b* having its surface coated with an elastic material. In this manner, the toner images are fixed on the paper sheet 6. Lastly, the paper sheet 6 conveyed to a cooling device 10 provided on the downstream side of the fixing device 7 is cooled down to an appropriate temperature, and is discharged through a paper discharging outlet 11.

(Edge Correcting Device for Sheet Materials)

Figure 2:
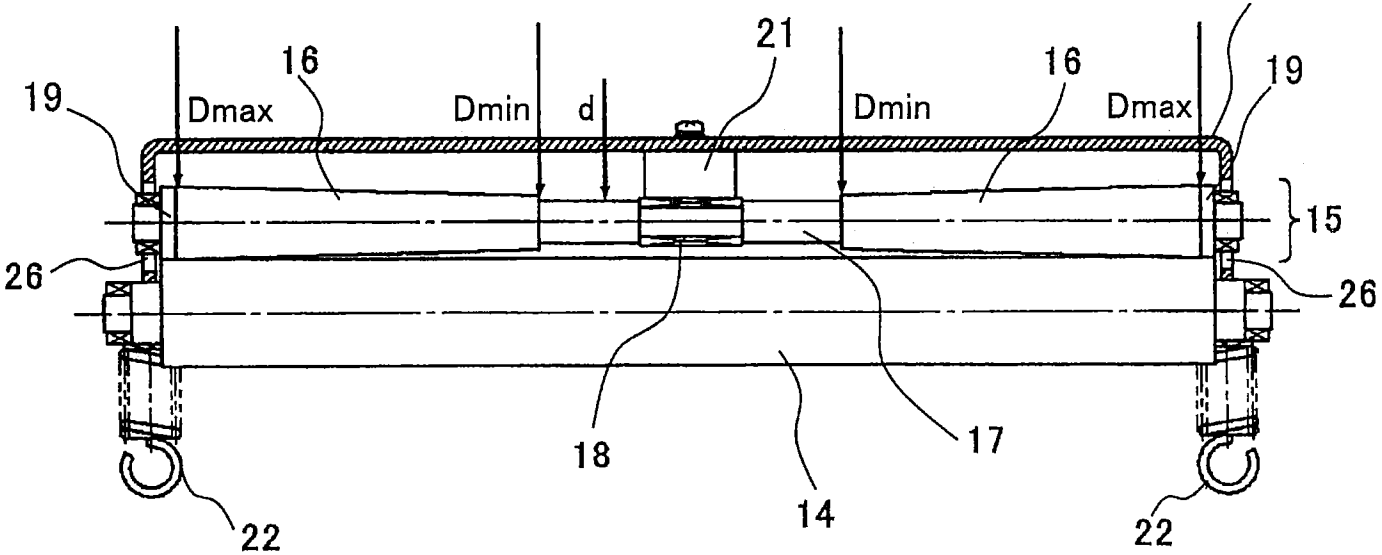
FIG. 2 is a front view of a burr squashing device as an edge correcting device for sheet materials according to an embodiment of the present invention.

FIG. 2 illustrates the entire structure of a burr squashing device as an edge correcting device for sheet materials according to an embodiment of the present invention. As illustrated in FIG. 1, the burr squashing device 12 is provided at a portion of the conveyance path of paper sheets 6 between the paper feeder 23 of the image forming apparatus and the second transfer unit 9 in contact with the intermediate transfer belt 8 and the conveyance path 24. It should be noted that it is also possible for the burr squashing device 12 to handle paper sheets conveyed from an additional paper feeder (not illustrated) through a conveyance path 13.

The burr squashing device 12 includes a first roller 14 connected to a drive unit (not illustrated), and a second roller 15 that is positioned to face the first roller 14 and is driven by the drive of the first roller 14. The second roller 15 includes rollers that have a substantially conical shape and are located on both sides of a center shaft 17, or conical rollers 16, for example. Each of the conical rollers 16 is designed to have an outer diameter that is larger on an outer side of the second roller 15 than on a central portion of the second roller 15.

Here, the difference in radius between the maximum diameter portion (Dmax) and the minimum diameter portion (Dmin) of each of the conic rollers 16 is restricted to a value equal to or smaller than the thickness of the thinnest paper sheet (Tmin) among paper sheets on which it is possible for the image forming apparatus to form images. This relationship is illustrated in the following expression (1):

$$(D\text{max}-D\text{min})/2 \leq T\text{min} \quad (1)$$

Also, the difference in radius between the outer diameter (d) of the center shaft 17 of the second roller 15 and the minimum diameter portion (Dmin) of each of the conical rollers 16 on both sides is restricted to a sufficiently larger value than the thickness (minimum thickness) (Tmin) of the thinnest paper sheet among paper sheets on which it is possible for the image forming apparatus to form images. This relationship is illustrated in the following expression (2):

$$(D\text{min}-d)/2 >> T\text{min} \quad (2)$$

The center portion of the center shaft 17 of the second roller 15 is pressed against the first roller 14, via a bearing 18, by a pushing member 21 of a pressing unit 20. As the second roller 15 bends to the first roller 14 at the center shaft 17, the conical rollers 16 are pressed against the first roller 14.

Figure 3:
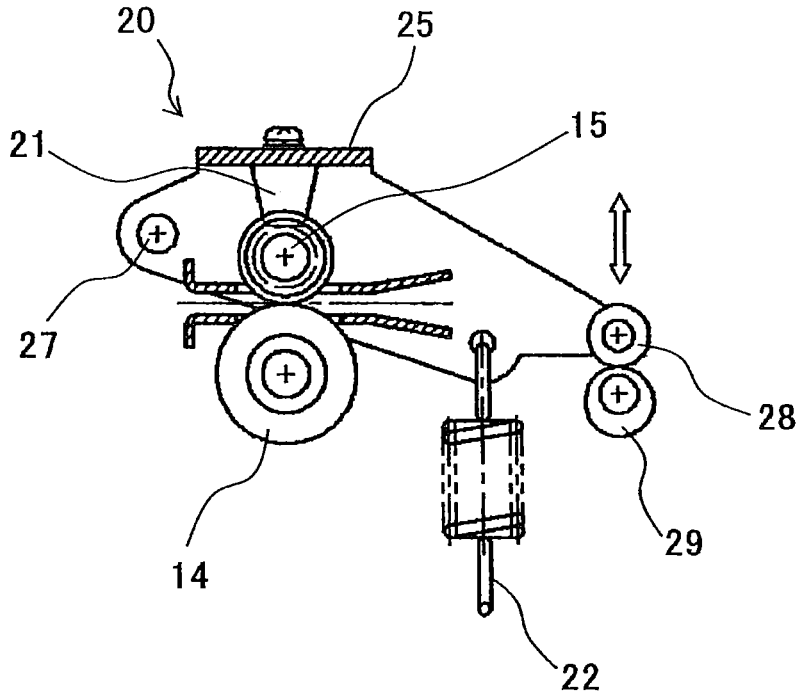
FIG. 3 is a side view of the burr squashing device illustrated in FIG. 2.
Figure 4:
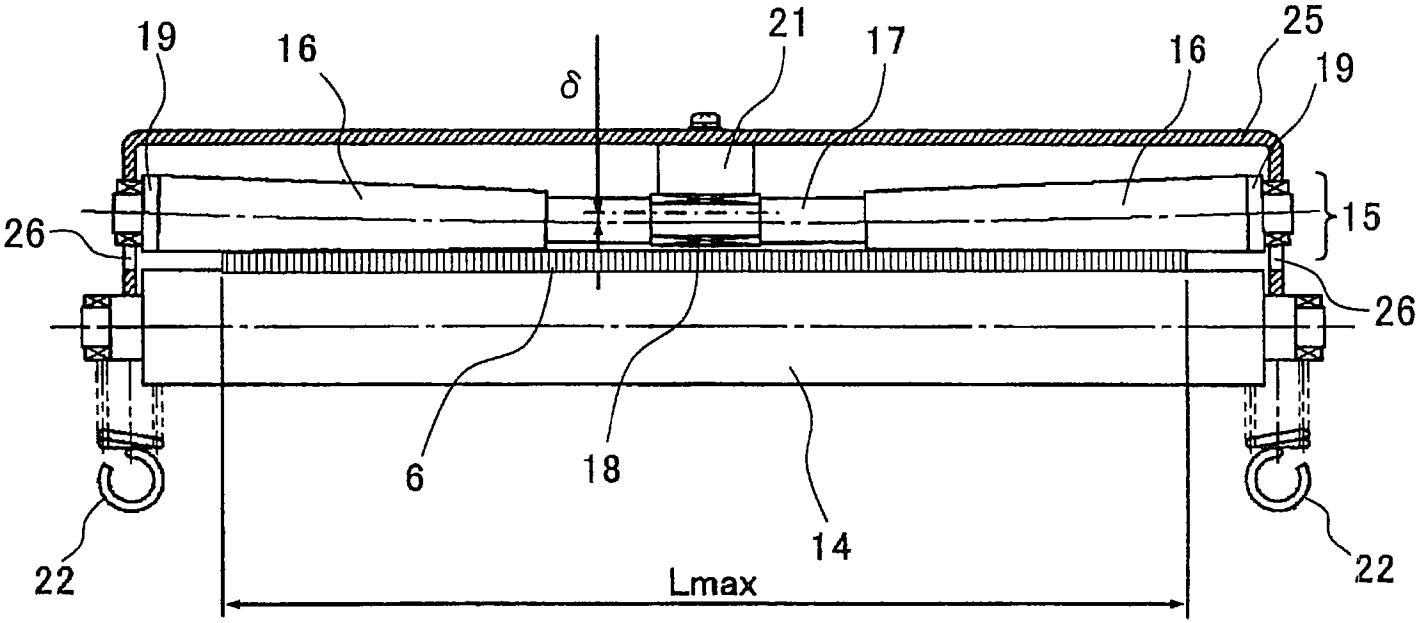
FIG. 4 is a front view of the burr squashing device at a time when a paper sheet of the largest width is passing therethrough.

FIG. 3 is a side view of the burr squashing device 12 illustrated in FIG. 2. Referring now to FIG. 3, the pressing unit 20 that presses the second roller 15 against the first roller 14 is described. FIG. 4 is a front view of the burr squashing device 12 at a time when a paper sheet of the largest width (Lmax) that may be able to be handled by the image forming apparatus is passing through the burr squashing device 12.

The pressing unit 20 includes an arm-like holder 25, the pushing member 21, a helical extension spring 22, and the like.

The arm-like holder 25 has an arm-like form, and holds the second roller 15 at both ends. The pushing member 21 is provided at the center portion of the arm-like holder 25 in the longitudinal direction (the width direction of the paper sheet). The arm-like holder 25 is pushed toward the first roller 14 by the helical extension spring 22.

The pushing member 21 has rigidity sufficient to maintain the shape thereof in spite of the load applied via the helical extension spring 22 and the arm-like holder 25. It is also possible for the pushing member 21 to maintain the shape of the bearing 18 that holds the center shaft 17 of the second roller 15. The material and the shape of the pushing member 21 are not particularly limited.

The bearing portions at both ends of the second roller 15 are formed with bearings, and the bearings each have an inner bearing diameter and a shaft outline such that it is possible to tilt the shaft of the second roller 15 by a predetermined amount.

The first roller 14 and the second roller 15 are designed so that the amount of deflection (δ) of the second roller 15 does not exceed the minimum thickness (Tmin) of paper sheets 6 when a paper sheet 6 of the maximum width (Lmax) is sandwiched between the first roller 14 and the second roller 15 by virtue of the helical extension spring 22 pressing the second roller 15 against the first roller 14 as illustrated in FIG. 4. This relationship is illustrated in the following expression (3):

$$\delta < T\text{min} \quad (3)$$

When the paper sheet 6 passes through the burr squashing device 12 that satisfies the above expressions (1) through (3), the situation illustrated in FIG. 4 is achieved, and the center shaft 17 of the second roller 15 bends to the first roller 14 by virtue of the pressing force of the pushing member 21. As a result, the edges of the paper sheet 6 in the paper width direction are pressed by the outer circumferences of the conical rollers 16 at both ends of the second roller 15, and, if there are burrs at the edges of the paper sheet 6, the burrs are squashed.

At this point, the load is obliquely applied from the conical rollers 16 to the edges of the paper sheet 6. Accordingly, it is possible to apply the load to the burrs exclusively, and it is possible to squash the burrs efficiently. Simultaneously, the load may not be applied to any portions other than the edges of the paper sheet 6. Accordingly, there may be no marks left on the surface of the paper sheet 6 by the pushing, and there may be no problems such as a decrease in image quality.

Also, when the paper sheet 6 passes through the burr squashing device 12 for printing on the second surface, the quality of the image already formed on the first surface may not be degraded.

Also, the second roller 15 preferably has cylindrical portions 19 at both ends thereof. The cylindrical portions 19 are connected to the outer sides of the conical rollers 16, and are parallel to the outer circumferential surface of the first roller 14. The second roller 15 is in contact with the first roller 14, and rotates following the first roller 14. Therefore, as the cylindrical portions 19 are provided, it is possible for the second roller 15 to rotate, by having the cylindrical portions 19 (more preferably, only two portions of the cylindrical portions 19 of the two conical rollers 16) in contact with the first roller 14 when any paper sheet 6 is not passing through the burr squashing device 12. Accordingly, any local contact pressure may not be generated, and it is possible to reduce scratches, wear, and the like on the surfaces of the first roller 14 and the second roller 15 in the paper conveying area.

Where the first roller 14 and the second roller 15 are made of an identical material, such as stainless steel or aluminum, the outer diameter of the first roller 14 is preferably larger than that of the center shaft 17 of the second roller 15. The ratio between the outer diameter of the center shaft 17 of the second roller 15 and the outer diameter of the conical rollers 16 at both ends may be determined by selecting an optimum value in accordance with the relationship between the minimum thickness (Tmin) among available paper sheets 6 and the length (or paper width) of the paper sheet 6 in the direction perpendicular to the conveying direction. Also, the length (Lr) of the first roller 14 and the second roller 15 may be determined by selecting an optimum value in accordance with the relationship with the paper width.

As described above, an image forming apparatus does not handle only paper sheets of an identical size and an identical thickness, but normally handles paper sheets of various widths (Lmin to Lmax) and various thicknesses (Tmin to Tmax). Therefore, in this case, the positions at which the conical rollers 16 of the second roller 15 come into contact with edges of paper sheets 6 vary depending on the widths of the paper sheets 6.

Figure 5:
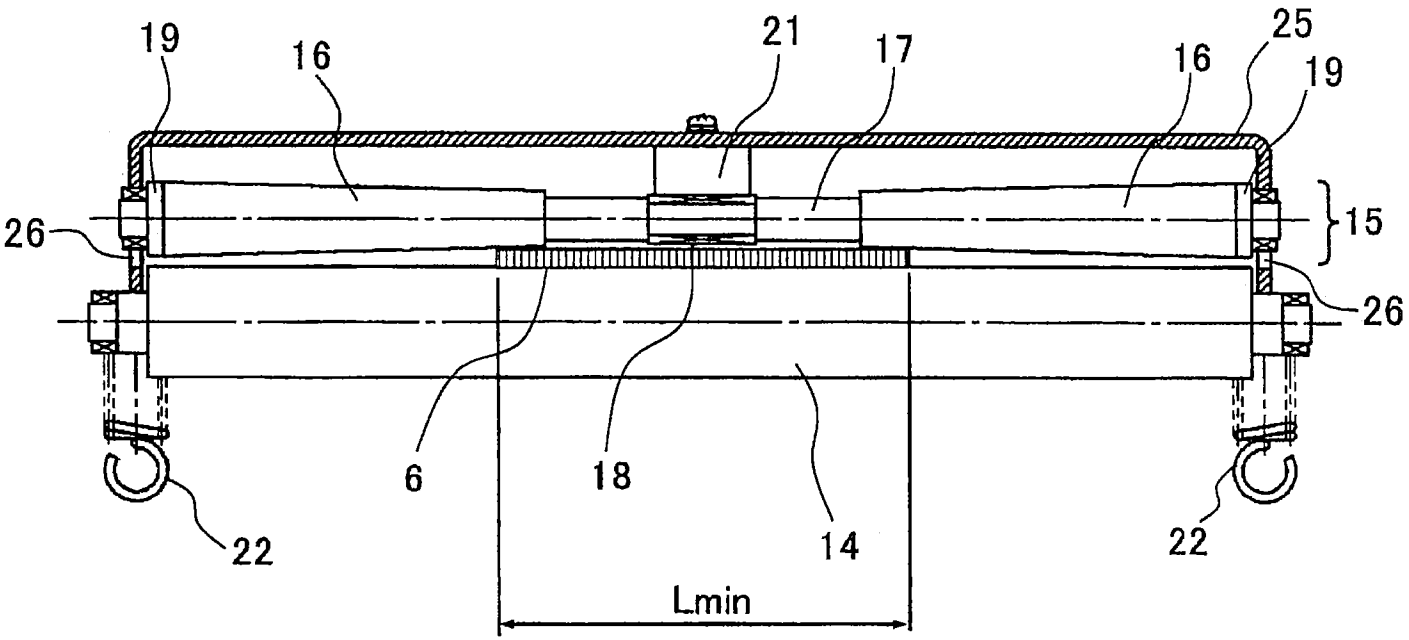
FIG. 5 is a front view of the burr squashing device at a time when a paper sheet of the smallest width is passing therethrough.

FIG. 5 is a front view of the burr squashing device 12 at a time when a paper sheet having the smallest width (Lmin) that may be able to be handled by the image forming apparatus is passing through the burr squashing device 12.

In this case, when the above described expressions (1) through (3) are satisfied, the center shaft 17 of the second roller 15 may not come into contact with the surface of the paper sheet 6. Accordingly, it is possible to apply the load only to edges of the paper sheet 6 as in the case of the paper sheet of the maximum width (Lmax), and it is possible to achieve effects identical to those in the case of the paper sheet of the maximum width (FIG. 4).

Also, with the amount of deflection (8) of the second roller 15 being taken into account, a sufficiently long distance is left between the bearing 18 and the paper sheet 6. Accordingly, it is possible to prevent the bearing 18 from coming into contact with the paper sheet 6.

In the case of a paper sheet 6 having a greater thickness than the minimum thickness (Tmin), the load is of course applied only to edges of the paper sheet as in the case of the paper sheet of the minimum thickness.

At the time of pressing with the pressing unit 20, the length (Lc) of each of the conical roller 16 in the axial direction is long enough to push the edge portions of paper sheets 6 parallel to the conveying direction of paper sheets 6 of all sizes to be conveyed by a center feed method. That is, the distance (the length of the center shaft 17) between the minimum diameter portions (Dmin) of the right and left conical rollers 16 is smaller than the width of a paper sheet 6 having the minimum width (Lmin), and the distance between the maximum diameter portions (Dmax) is longer than the width of a paper sheet having the maximum width (Lmax).

Specific example of structures of the paper sheets 6, the second roller 15, and the conical rollers 16 used in the burr squashing device 12 of this embodiment are now described.

[Paper Sheets 6]

Minimum paper thickness Tmin=0.12 mm

Minimum paper width Lmin=100 mm

Maximum paper width Lmax=330 mm

[Second Roller 15]

Amount of deflection 6=0.1 mm

Shaft diameter d of the center shaft 17=10 mm in diameter

Length Lr in the axial direction=370 mm

[Conical rollers 16]

Maximum diameter portion Dmax=20.00 mm in diameter

Minimum diameter portion Dmin=19.90 mm in diameter

Length Lc in the axial direction of the conical rollers=145 mm $$Lr>L\max, Lr-2Lc<L\min$$

In this embodiment, the outer circumferential surfaces of the conical rollers 16 at both ends of the second roller 15 each have a conical shape that is larger on the outer side than on the center side. However, each of the outer circumferential surfaces may not have a perfect conical shape, but may have a curved shape (a substantially conical shape) that is partially or entirely larger in the outer diameter on the outer side than on the center side.

Next, a mechanism (a separating unit) to release the pressing unit 20 from a pressing state is described. There are various kinds of paper sheets that may be able to be handled by electrophotographic image forming apparatuses these days, and it is possible to perform printing even on a paper sheet having uneven thickness, such as embossed paper. In the case of embossed paper, it is not desirable to damage the embossed pattern. Therefore, it is preferable to restrain the burr squashing device 12 from operating, and release the second roller 15 from a pressing state.

A control unit of the image forming apparatus determines whether to drive the separating unit, by obtaining information about paper to be used (paper type or the like) from print data or the like, or sensing a paper surface with a surface sensor. Based on the obtained information, the control unit determines whether to drive the separating unit.

Operations of the separating unit are now described. As illustrated in FIG. 3, the second roller 15 is connected to both sides of the arm-like holder 25 by slots 26 each having such a space to allow a certain amount of movement in the vertical direction (see FIG. 2).

The arm-like holder 25 is rotatably held about a rotational shaft 27 at one end (on the side of the nip outlet). With this structure, it is possible for the second roller 15 to shift in the direction indicated by an arrow.

A bearing 28 is provided on the side of the other end of the arm-like holder 25 (or on the side of the nip inlet), and an eccentric roller 29 connected to a drive unit (not illustrated) is in contact with the bearing 28. The drive unit is controlled by the control unit of the image forming apparatus. When printing is performed on embossed paper or the like as described above, the drive unit rotates the eccentric roller 29, and drives and controls the eccentric roller 29 to push up the bearing 28, so that the second roller 15 is separated from the first roller 14. In this manner, it is possible for the pressing unit 20 of the burr squashing device 12 to prevent a decrease in image quality and the like, without pressing the embossed paper or the like.

It is possible for the above described burr squashing device according to this embodiment to handle various kinds of sheet materials of different sizes, and efficiently squash burrs of sheet materials by applying the burr squashing load exclusively to edge portions of the sheet materials.

That is, the above described expressions (1) through (3) are satisfied, so that deflection of the shaft may be optimized in accordance with width and thickness, and the load is efficiently applied to the edge portions of the sheet materials parallel to the conveying direction. In this manner, it is possible to squash burrs efficiently.

Also, the load may not be applied to any portions other than the end portions of sheet materials of various sizes and various thicknesses. Accordingly, no marks may be left as a result of pressing on the surfaces of the sheet materials, and printing quality may not be adversely affected. In an image forming apparatus that performs double-side printing, any load may not be applied to surfaces already having images printed thereon. Accordingly, it is possible to prevent decreases in image quality.

With the image forming apparatus (illustrated in FIG. 1) including the above described burr squashing device 12, it is possible to squash burrs at edge portions of sheet materials efficiently. Accordingly, it is possible to provide an image forming apparatus that may be able to reduce wear of the fixing belt or the like of the fixing device 7.

Further, the present invention is not limited to these embodiments, but various variations and modifications may be made without departing from the scope of the present invention.

Example

Figure 6:
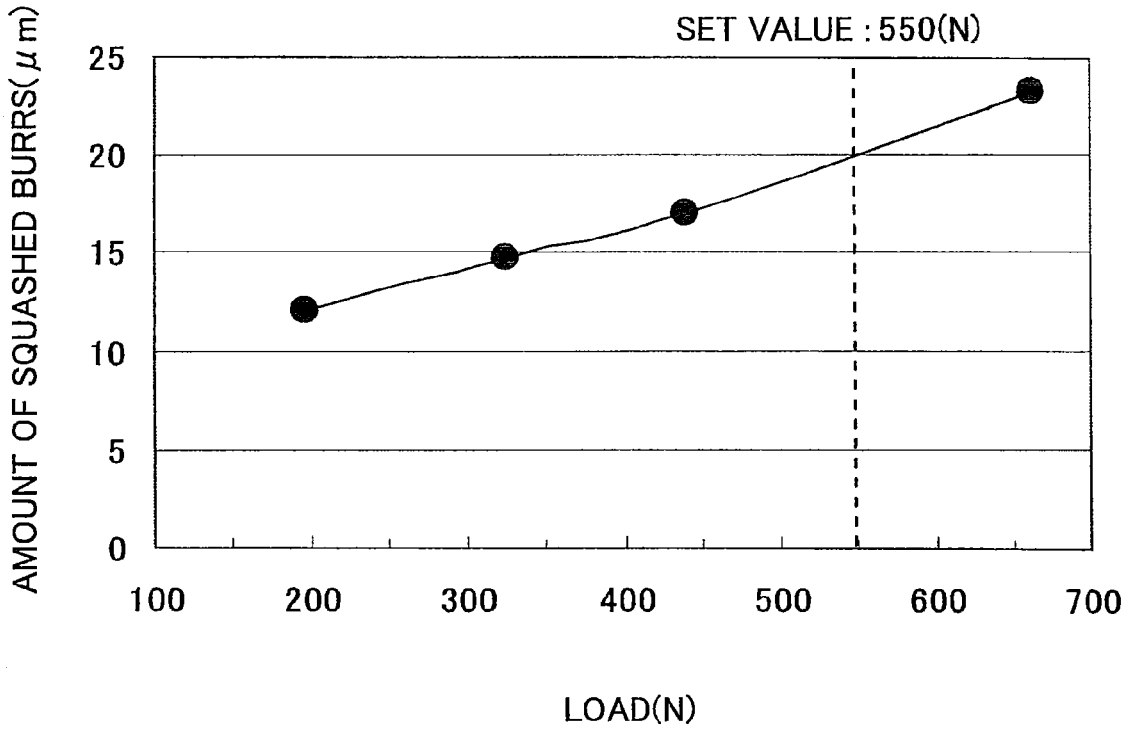
FIG. 6 is a graph illustrating the relationship between the load applied to the second roller and the amount of squashed burrs of a paper sheet.

FIG. 6 illustrates an example of a result of an experiment conducted to examine the relationship between the load (N) applied to the center shaft 17 of the second roller 15 by the pushing member 21 and the amount of squashed burrs (μm) of a paper sheet 6.

Where the load was set at 550 (N), approximately 20 μm of squashed burrs were observed, and a sufficient wear preventing effect of the fixing belt was confirmed.

APPENDIX

An Illustrative Embodiment(s) of an Edge Correcting Device for Sheet Materials, and an Image Forming Apparatus At least one illustrative embodiment of the present invention may relate to an edge correcting device for sheet materials and an image forming apparatus, and more particularly, to a sheet material edge correcting device that removes burrs from edge portions of sheet materials, and an image forming apparatus that includes the edge correcting device.

An object of at least one illustrative embodiment of the present invention may be to provide a sheet material edge correcting device that can handle various kinds of sheet materials of different sizes, and can efficiently squash burrs of the sheet materials by applying a burr squashing load exclusively to edge portions of the sheet materials.

At least one illustrative embodiment of the present invention may be an edge correcting device for sheet materials is provided in an image forming apparatus that forms images on sheet materials having different lengths in a direction perpendicular to a conveying direction, wherein the edge correcting device includes: a first roller provided in a conveyance path for conveying the sheet materials; a second roller that is pressed against the first roller and rotates, the second roller including substantially conical rollers on both sides thereof, the substantially conical rollers each having an outer diameter that is larger on the outer side than on the center side, the second roller having a center shaft connecting the substantially conical rollers located on both sides, the center shaft having a smaller outer diameter than the minimum diameter portion of the substantially conical rollers; and a pressing unit that presses the second roller against the first roller at a position near the center of the second roller, wherein the pressing unit causes the second roller to bend to the first roller, to press the substantially conical rollers of the second roller against the first roller.

Illustrative embodiment (1) is an edge correcting device for sheet materials in an image forming apparatus that forms images on sheet materials having different lengths in a direction perpendicular to a conveying direction, the edge correcting device including: a first roller provided in a conveyance path for conveying the sheet materials; a second roller that is pressed against the first roller and rotates, the second roller including substantially conical rollers on both sides thereof, the substantially conical rollers each having an outer diameter that is larger on an outer side than on a center side, the second roller having a center shaft connecting the substantially conical rollers located on both sides, the center shaft having a smaller outer diameter than a minimum diameter portion of the substantially conical rollers; and a pressing unit pressing the second roller against the first roller at a position near the center of the second roller, wherein the pressing unit causes the second roller to bend to the first roller, to press the substantially conical rollers of the second roller against the first roller.

Illustrative embodiment (2) is the edge correcting device for sheet materials as described in illustrative embodiment (1), wherein the substantially conical rollers each have a width large enough to press edge portions of all the sheet materials having different lengths in the direction perpendicular to the conveying direction, the edge portions being parallel to the conveying direction.

Illustrative embodiment (3) is the edge correcting device for sheet materials as described in illustrative embodiment (1) or (2), wherein a difference in radius between a maximum diameter portion and the minimum diameter portion of the substantially conical rollers is equal to or smaller than a thickness of the sheet materials, a difference in radius between the outer diameter of the center shaft and the minimum diameter portion of the substantially conical rollers is larger than the thickness of the sheet materials, and when one of the sheet materials having the largest length in the direction perpendicular to the conveying direction is sandwiched between the first roller and the second roller, the pressing by the pressing unit is such that an amount of deflection of the center portion of the second roller is smaller than the thickness of the sheet material.

Illustrative embodiment (4) is the edge correcting device for sheet materials as described in any one of illustrative embodiments (1) to (3), further including cylindrical portions at both ends of the second roller, the cylindrical portions being connected to the substantially conical rollers and having outer circumferential surfaces parallel to an outer circumferential surface of the first roller.

Illustrative embodiment (5) is the edge correcting device for sheet materials as described in any one of illustrative embodiments (1) to (4), further including a separating unit configured to cause the pressing unit to stop the second roller from pressing the first roller.

Illustrative embodiment (6) is the edge correcting device for sheet materials as described in any one of illustrative embodiments (1) to (5), wherein the substantially conical rollers are conical rollers each having an outer diameter that is larger on the outer side than on the center side.

Illustrative embodiment (7) is an electrophotographic image forming apparatus comprising the edge correcting device for sheet materials as described in any one of illustrative embodiments (1) to (6).

According to at least one illustrative embodiment of the present invention, it may be possible to provide that various kinds of sheet materials of different sizes may be able to be handled, and burrs of sheet materials may be able to be efficiently squashed by applying a burr squashing load exclusively to edge portions of the sheet materials.

Although the illustrative embodiments and specific examples of the present invention have been described with reference to the accompanying drawings, the present invention is not limited to any of the illustrative embodiments and specific examples and the illustrative embodiments and specific examples may be altered, modified, or combined without departing from the scope of the present invention.

The present application claims the benefit of priority based on Japanese Patent Application No. 2012-060460 filed on Mar. 16, 2012 and Japanese Patent Application No. 2012-234678 filed on Oct. 24, 2012, the entire contents of which are hereby incorporated by reference herein.

What is claimed is:

1. A method for correcting an edge portion of a sheet material, comprising:

passing the sheet material through an edge correcting device, wherein the edge correcting device comprises:

a first roller provided in a sheet material conveying path;

a second roller including a center shaft and side rollers provided at both sides thereof, the center shaft having an outer diameter less than a minimum diameter of the side rollers, each of the side rollers having an outer diameter increasing from a center side to an outer side thereof; and a pressing unit configured to bend the second roller toward the first roller to press the side rollers of the second roller against the first roller, wherein a difference between a maximum radius and a minimum radius of each of the side rollers is less than or equal to a thickness of the sheet material, wherein a difference between a radius of the center shaft and a minimum radius of each of the side rollers is greater than the thickness of the sheet material, and wherein when a sheet material having a length largest in a direction orthogonal to a sheet material conveying direction is sandwiched between the first roller and the second roller, a pressure is applied by the pressing unit in such a manner that an amount of deflection of the center portion of the second roller is less than the thickness of the sheet material.

2. The method for correcting an edge portion of a sheet material as claimed in claim 1, wherein each of the side rollers has a width capable of pressing edge portions of sheet materials with different lengths in a direction orthogonal to the sheet material conveying direction and the edge portions are parallel to the conveying direction.

3. The method for correcting an edge portion of a sheet material as claimed in claim 1, wherein the edge correcting device further comprises cylindrical portions at both ends of the second roller, and wherein the cylindrical portions are connected to the side rollers and have circumferential surfaces parallel to a circumferential surface of the first roller.

4. The method for correcting an edge portion of a sheet material as claimed in claim 1, wherein the edge correcting device further comprises a removal unit configured to remove a pressure applied to the first roller by the second roller.

5. The method for correcting an edge portion of a sheet material as claimed in claim 1, wherein each of the side rollers is a substantially conical roller with an outer diameter increasing from a center side to an outer side thereof.

6. The method for correcting an edge portion of a sheet material as claimed in claim 1, wherein the pressing unit includes an arm-like holder which holds the second roller at both ends thereof, and a pushing member provided in a center portion of the arm-like holder in the direction orthogonal to the sheet material conveying direction.

7. The method for correcting an edge portion of a sheet material as claimed in claim 6, wherein the arm-like holder includes slots at each side, the slots holding the ends of the second roller and including a space that allows movement of the second roller in a vertical direction.

8. The method for correcting an edge portion of a sheet material as claimed in claim 6, wherein the arm-like holder is rotatably held about a rotational shaft at a first side of the arm-like holder, and a bearing and an eccentric roller in contact with the bearing is provided on a second side of the arm-like holder.

* * * * *